United States Patent [19]

Darredeau et al.

[11] 3,945,214

[45] Mar. 23, 1976

[54] METHOD AND APPARATUS FOR COOLING A GAS

[75] Inventors: Bernard Darredeau, Montreal, Canada; Pierre Cappiello, Boulogne; Herve Le Bihan, Vitry-sur-Seine, both of France

[73] Assignee: Societe des Procedes l'Air Liquide et Technip de Liquefaction des Gaz Naturels, Paris, France

[22] Filed: July 3, 1974

[21] Appl. No.: 485,535

[30] Foreign Application Priority Data

July 3, 1973 France ..... 73.24328

[52] U.S. Cl. ..... 62/54; 62/23; 62/512

[51] Int. Cl.[2] ..... F17C 13/00

[58] Field of Search ..... 62/11, 23, 114, 54, 512; 220/85 VR

[56] References Cited

UNITED STATES PATENTS

| | | | |
|---|---|---|---|
| 3,541,802 | 11/1970 | Swearingen | 62/23 |
| 3,702,063 | 11/1972 | Etzbach et al. | 62/23 |
| 3,729,945 | 5/1973 | Linnett | 62/11 X |

*Primary Examiner*—William F. O'Dea
*Assistant Examiner*—Ronald C. Capossela
*Attorney, Agent, or Firm*—Flynn & Frishauf

[57] ABSTRACT

The present invention relates to methods and a system for cooling a gas for the purpose of effecting the liquefaction of one or more components of this gas. The invention is more precisely concerned with the prevention of losses by evaporation from the tanks of methane-carrier ships during the transport of liquid methane. For this purpose, the evaporation leakages from the tanks in gaseous form are re-liquefied by ad hoc liquefaction apparatus aboard the ship. The apparatus utilizes a cascade frigorific cycle of the open type working with a single refrigerant having a plurality of components. The refrigerant comprises the pure substance to be re-liquefied, and at least one heavy component, less volatile than the said substance, and absent from the composition of the gas treated.

18 Claims, 1 Drawing Figure

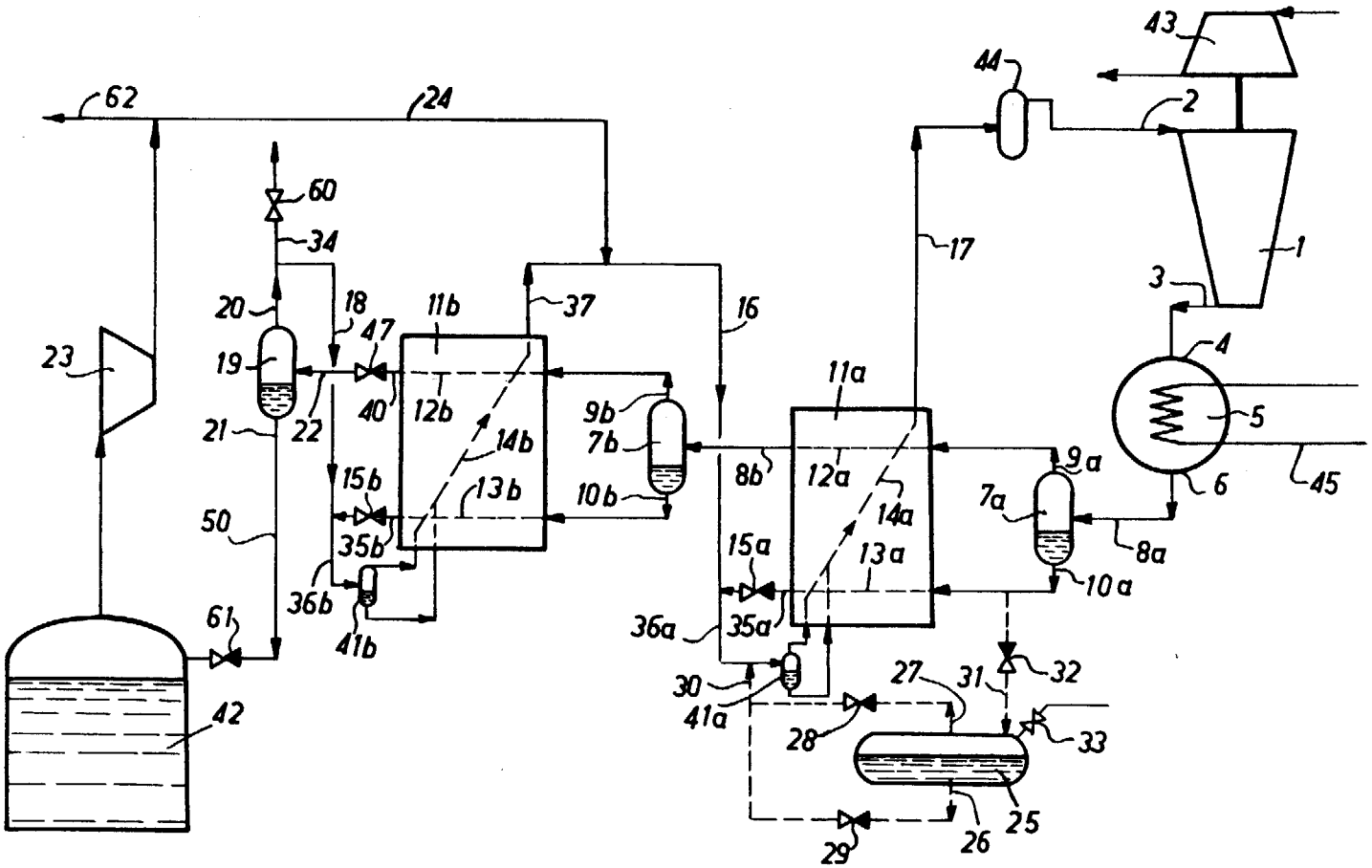
1
2
3
4
5
6
7a
7b
8a
8b
9a
9b
10a
10b
11a
11b
12a
12b
13a
13b
14a
14b
15a
15b
16
17
18
19
20
21
22
23
24
25
26
27
28
29
30
31
32
33
34
35a
35b
36a
36b
37
40
41a
41b
42
43
44
45
47
50
60
61
62

METHOD AND APPARATUS FOR COOLING A GAS

FIELD OF THE INVENTION

The present invention is concerned with the cooling of a gas for the purpose of ensuring the liquefaction of at least one component or all of the components of this gas. More precisely, the invention relates to the liquefaction of the evaporations from a storage of liquefied natural gas.

BACKGROUND OF THE INVENTION

For at least 10 years, the transport by sea of natural gas in the liquid form has entered an industrial era. At the present time, there exists an important world trade in natural liquefied gas, in which this source of energy is liquefied in the producer countries, conveyed by sea by means of ships specially designed for that purpose to the consumer countries, and finally vaporized in the latter countries so as to be determined towards the various points of utilization.

This sea transport is carried out by means of methane ships comprising reception tanks for the liquefied natural gas, thermally insulated in such manner as to be able to keep this cargo under a pressure in the vicinity of atmospheric pressure and at temperatures in the neighborhood of −160°C.

The thermal insulation employed is of course not perfect, and a small part of the cargo necessarily becomes vaporized during the course of storage in the methane ship. Furthermore, another part of the liquefied gas becomes vaporized voluntarily or accidentally during the exploitation cycle of the methane ship, for example during the return of the empty ship to a producer country by maintaining the tanks under cold by vaporization of liquefied natural gas along their walls, or during the loading of the cargo of liquefied gas.

By way of example, a methane ship carrying 125,000 cu.m. of liquefied natural gas loses about 0.25% of its cargo per day. For this same ship, 2% of the volume carried is lost for an outward and return journey, each of 4 days.

Under normal conditions of utilization of methane ships, the quantities of vaporized natural gas are thus not negligible, and the problem thus arises of recovering these evaporations, composed in general of methane with possibly a small proportion of nitrogen.

Up to the present time, the natural gas vaporized on board the ship was either discharged to the atmosphere or burned in the boilers of the ship. This solution is becoming less and less satisfactory for the following reasons. On the one hand, in view of the shortage of natural gas and its increasingly high cost, it is becoming prohibitive to definitely lose these evaporations or to burn them in the boilers when other fuels are better suited or less expensive. On the other hand, in view of the increasingly high cost of liquefied natural gas, resulting from the production, transport and delivery of this source of energy, it is becoming imperative to make the necessary capital investments more profitable, by increasing the carrying capacity of the methane ships for the available volume of storage.

For all these reasons, it has now become economically very advantageous to liquefy the evaporations arising from the storage of liquefied natural gas on board the methane ship. The cost of liquefying apparatus utilized is low compared with the gain obtained by increasing the carrying capacity of the methane ship.

PRIOR ART

Numerous systems and methods of liquefaction are available at the present time, but as will be examined below, none would appear to be suitable for the surroundings and the conditions of utilization of a methane ship.

In fact, the utilization on land of a liquefying apparatus, for example for liquefying the evaporations from a fixed storage, does not in general create any particular difficulty, in view of the existence of a generally qualified staff to ensure the operation of the installation, and the possibility of the intervention of specialists in the event of an accident or breakdown. This is not the case for a liquefying apparatus mounted on board a ship, the design of which must comply with the following necessary conditions:

1. the liquefying apparatus can be operated by a staff not qualified for the operation of this type of installation;
2. it does not necessitate any action of specialists for long periods of time, and in particular during at least one cycle of exploitation of the methane ship;
3. it is self-sufficient in refrigerant fluid for the periods during which the methane ship is at sea;
4. it in no way affects the safety of the ship, in particular by the use of excessively high working pressures;
5. it does not necessitate any considerable auxiliary apparatus, such as pumps, compressors, etc.;
6. the composition of the re-liquefied evaporations is substantially identical with that of evaporations taken from the storage, in order to preserve the initial composition of the cargo during the course of transport.

All these conditions thus necessitate the design of a liquefaction equipment having great reliability and a high degree of simplicity in operation.

It may be contemplated initially to liquefy the evaporations of the liquefied natural gas by means of an open frigorific cycle, by free expansion of the natural gas from a high pressure to a low pressure. In this case, the high pressure required is too high, of the order of 150 bars, in order to satisfy the conditions of safety required for the use of methane ships.

The pressure necessary for the liquefaction of the evaporations can be reduced by utilizing a frigorific cycle of the closed cascade type, in which each stage works with a pure substance during the course of vaporization (for example, a first stage working with propane, and a second stage working with ethylene). However, in this case, the result is a liquefying device having a limited reliability in view of the number of rotating machines (one compressor per stage), and having a relative complexity of operation.

It has already been proposed to liquefy the evaporations from a storage of liquefied natural gas by means of a closed frigorific cycle working by isentropic expansion (that is to say by expansion with simultaneous production of work) of an appropriate fluid such as nitrogen. In this case, the evaporations are condensed at atmospheric pressure by exchange with the expanded gaseous nitrogen in course of re-heating. In this case also, however, the reliability of the liquefying apparatus is limited since it utilizes three rotating machines (compressor and an expansion turbine associated with a brake-compressor). Furthermore, liquefaction under atmospheric pressure necessitates the employment of equipment accessory to the liquefying apparatus, such as a pump working at low temperature for returning the liquefied evaporations to the storage tanks.

It is also possible to liquefy these evaporations by means of a single-flow cascade cycle known as an "incorporated cascade cycle," utilizing a single refrigerant comprising a plurality of pure substances. A cycle of this kind has formed the subject of U.S. Pat. Nos. 3,218,816 and 3,274,787, and also of U.S. Pat. No. 3,364,685.

In this case, the incorporated cascade cycle utilized may be of the closed type and the evaporations are then condensed under pressure, and separately with respect to the refrigerant, by exchange of heat with the latter during the course of vaporization.

A cycle of this kind is incompatible with the conditions of exploitation of a methane ship for the following reasons:

in view of the inevitable losses of refrigerant (by leakages, etc.), this cycle necessitates the utilization of a number of independent auxiliary storages for each of the components of the refrigerant (for example, ethane, propane, butane and possibibly nitrogen). While the methane can be readily obtained from the cargo of liquefied natural gas, a pump is, however, necessary in order to introduce this component into the liquefying apparatus at the low pressure of the cycle, in spite of the possibility of providing the liquefying apparatus with numerous regulating devices, manual regulation of the compositions of the refrigerant remains constantly necessary in order to obtain an optimum composition of the refrigerant. Therefore, this necessitates the presence of a qualified staff on board the methane ship.

The problem of the regulation of the composition of the refrigerant and of the auxiliary storages in pure substances can be partly resolved by the utilization of an incorporated cascade cycle of the open type.

According to this method, the evaporations are cooled in order to liquefy the methane and subsequently the nitrogen of this gas, by utilizing a frigorific cycle of the open type working with a single multicoponent refrigerant comprising methane, ethane, propane, butane, and possibly nitrogen. This cycle consists of:

1. compressing at least the refrigerant from a low pressure (one of several atmospheres) to a higher pressure (for example, of the order of 30 atmospheres);
2. subjecting a gaseous mixture comprising at least the compressed refrigerant to a fractional condensation under said higher pressure, thereby obtaining a plurality of condensed fractions; a first condensed fraction is obtained after partial condensation of at least the compressed refrigerant, in heat-exchange with a refrigerant external to the said cycle, such as water; and the gaseous fraction separated from said first condensed fraction follows the fractional condensation;
3. expanding each condensed fraction to the low pressure;
4. combining under the low pressure, at least one expanded condensed fraction with at least the refrigerant circulating under this pressure;
5. vaporizing at least said expanded fraction combined with the refrigerant;

6. heating at least the refrigerant which is under low pressure, in heat-exchange with the gaseous mixture in course of fractional condensation at the higher pressure.

This cycle is of the open type. Consequently, the refrigerant is simultaneously combined with the evaporations; and the methane to be liquefied (and possibly the nitrogen) is separated after condensation, at the end of the fractional condensation, from a residual gaseous portion of the refrigerant, and removed from the frigorific cycle.

The re-combination of the refrigerant and the gas to be liquefied may be effected under the low pressure, for example at the suction of the compressor after heating the gas treated to the ambient temperature and re-compression at the low pressure, or under the high pressure, for example at the delivery of the compressor after heating to the ambient temperature and re-compression at the higher pressure, or during the course of cooling of the refrigerant, in which case the gas treated is cold or previously cooled by heat exchange with the refrigerant.

This cycle simplifies the problem of auxiliary storage and the regulation of the composition of the refrigerant, since the methane and possibly the nitrogen are present in the evaporations and are directly introduced without auxiliary apparatus into the frigorific cycle.

While this solution appears at first sight to be advantageous for the case of a liquefying apparatus intended for installation on board a methane ship, it is, however, unsuitable due to the following problem. It is impossible to separate completely the ethane of the refrigerant and the re-liquefied methane of the evaporation at the end of the fractional condensation. The evaporations thus carry away with them towards the storage a significant portion of the ethane of the refrigerant, which is incompatible with the maintenance of a cargo of liquefied natural gas having a fixed composition.

At the end of this analysis of the various solutions available for resolving the problem set, none would therefore appear to be really suitable under the conditions of exploitation and surroundings of a methane ship.

In consequence, the need for a liquefaction cycle specifically adapted for methane ships remains unsatisfied, and the present invention therefore proposes to define essentially a method of liquefaction satisfying the necessities of exploitation defined above, and more particularly a process of liquefaction comprising one single rotating machine, which can be fully regulated, this process thus being especially reliable and permitting completely automatic operation.

According to the invention, it has been discovered that these objectives could be entirely satisfied by improving the incorporated cascade cycle of the open type previously detailed, and more precisely by simplifying the latter.

SUMMARY OF THE INVENTION

Within the framework of an incorporated cascade cycle of the open type, it has in fact been discovered that by utilizing a refrigerant which does not contain either ethane or ethylene, and is thus constituted by methane and possibly nitrogen, but also by propane and butane, it is possible on the one hand to comply with the requirements formulated above, and on the other hand to liquefy the evaporations without substantially effecting their composition.

More precisely, according to the invention, the refrigerant mixed with the evaporations comprises main components distributed exclusively between:

- a light fraction comprising methane (the least volatile light component, identical with the least volatile main component of the treated gas to be cooled and/or condensed), and optionally nitrogen;
- a heavier fraction comprising propane (the most volatile heavy component) and butane (another heavy component). These are essentially absent from the gas to be cooled. Their normal boiling points are separated from that of methane by a gap of 119°C. and 162°C., respectively.

SPECIFIC EMBODIMENTS OF THE INVENTION

The evaporations are combined in the refrigerant thus defined and the mixture thus constituted is compressed at the high pressure of the cycle and is then subjected to a fractional condensation. This mixture before the separation of the first condensed fraction thus exclusively comprises a heavy portion comprising the heavy fraction (propane and butane) of the refrigerant and a light portion comprising the components of the gas to be liquefied and the light fraction of the refrigerant (methane and nitrogen, if present) of the evaporation.

The mixture according to the invention, subjected to a fractional condensation, is thus characterized by a large discontinuity in the volatilities of the components circulating in the frigorific cycle, this being due to the absence of ethane and ethylene. There exists in fact a discontinuity of 119°C. between the normal boiling point under atmospheric pressure of methane (−161°C.), constituting the least volatile component of the light fraction of the refrigerant, and the normal boiling point of propane (−42°C.) constituting the most volatile component of the heavy fraction of the refrigerant.

The result is that, during the process of fractional condensation, the heavy portion (propane and butane) is very easily separated from the light portion (methane and nitrogen, if present) and it is thus very easy to re-constitute the heavy fraction and the light fraction of the refrigerant in the gaseous state under the low pressure, while separating the components of the treated gas under the high pressure, the components being produced in the liquid state.

In this way, the re-liquefied evaporations delivered by the liquefying system have a substantially identical composition, in methane (and nitrogen, if present), to that of the evaporations extracted from the storage of liquefied natural gas, and contain only a negligible proportion of propane and butane (less than 0.3% by volume).

In view of the very good separation of the propane and the butane with respect to the methane, a liquefaction cycle according to the invention is therefore original in that it behaves thermally substantially like a free expansion cycle permitting the final liquefaction of the methane, co-operating with a separate flow cascade cycle comprising two stages working with butane and propane, ensuring the initial cooling of the methane.

In this case, however, the frigorific cycle according to the invention makes it possible to eliminate the drawbacks attached at the same time to the free expansion cycle and to the separate flow cascade cycle previously discussed.

In a surprising manner and contrary to what might have been expected, it has been found that the consumption of a liquefaction cycle in accordance with the invention is not prohibitive, especially taking into account the low capacity of the liquefaction installation, and that it is in any case comparable to that of an isentropic expansion cycle of nitrogen, as previously referred to.

In order to obtain a good power efficiency, it is in fact generally admitted for an incorporated cascade cycle, that the refrigerant must have, for the low pressure, a vaporization curve (that is to say, a curve expressing the quantity of heat recovered by the refrigerant as a function of the temperature) having a form similar to that of the condensation curve of the gaseous mixture in course of cooling under high pressure (that is to say, a curve expressing the quantity of heat delivered by the gaseous mixture as a function of the temperature), in such manner that the differences of temperature in the exchangers are small.

This results, for example, from the publication by Kleemenko to the Tenth International Cold Congress at Copenhagen in 1959 (Pergamon Press, 1960, Vol. 1, pages 34 to 39). This condition can only be satisfied for a refrigerant comprising a large number of components, the respective volatilities of which do not show with respect to each other any considerable discontinuity, that is to say, in which the intervals between the successive boiling temperatures are relatively uniform.

Thus, it is surprising, within the scope of the invention, to find that for a low liquefaction capacity, the energy performances are not substantially affected for a refrigerant which does not contain ethane or ethylene, and which thus has a discontinuity of 119°C. on the plan of the absolute volatilities of the components of the cycle mixture.

In conclusion, the invention provides a liquefying system specially adapted to a methane ship for the following reasons:

- the composition of the cargo is not substantially affected by the re-liquefaction of the evaporations, due to the good separation of the refrigerant from the liquefied gas;
- by virtue of the easy separation of the components utilized, the liquefaction cycle only comprises two stages. The operation of the liquefying system can therefore be easily made automatic, and it then necessitates no qualified staff. In particular, its operation is then not more complicated than that of a domestic refrigerator;
- since the methane of the refrigerant is extracted from the evaporations, it necessitates only a limited storage of propane and butane, which may be a single container when these components are mixed together in pre-determined proportions, and which furthermore can be carried out at atmospheric temperature;
- it ensures the liquefaction of the evaporations at a relatively-low high pressure (for example of the order of about 30 atmospheres), which does not affect the safety of the ship;
- when the low pressure is higher than the storage pressure, the re-liquefied evaporations can be correctly returned and distributed to the tanks, without the aid of auxiliary equipment such as cryogenic pumps.

While the invention which has just been described has been explained within the framework of the re-liquefaction of evaporations in methane ships, it has also been discovered that the principles given above can be applied generally to any cooling of a gas playing the part of the evaporations, in order to liquefy at least one component of the said gas, playing the part of the methane, utilizing a single flow frigorific cycle of an incorporated cascade cycle of the open type, working with a refrigerant comprising a plurality of components.

Very generally, in order to be able to liquefy easily at least one component of the gas treated, it is only necessary that the refrigerant chosen should possess main components distributed exclusively between a light fraction, of which the least volatile light component is identical with the least volatile main component of the gas to be cooled, and a heavy fraction, the most volatile heavy component of which is essentially absent from the gas to be cooled, and has a normal boiling point separated from that of the least volatile light component by a discontinuity of at least 70°C. The refrigerant utilized thus has an average molecular weight higher than that of the gas treated.

By virtue of the fundamental characteristic of the invention, it is thus possible to simplify to a great extent the use of an incorporated cascade frigorific cycle of the open type, and to make this cycle perfectly suited to the liquefaction of a single pure substance.

The invention thus makes it possible to convert this frigorific cycle to a liquefying cycle, that is to say, to a liquefaction installation of small capacity compared with the production capacity of an installation for the production of liquefied natural gas of the "peak-shaving" or "base-load" type. In consequence, the invention permits the introduction of the incorporated cascade cycle of the open type in a new technical branch of liquefaction and cooling.

By utilizing the principle of the invention, it is thus possible to liquefy nitrogen (component to be liquefied) by means of an incorporated cascade cycle of the open type, in which the heavy fraction of the refrigerant comprises for example ethane, propane, and possibly butane (heavy components). Similarly, according to the same principle, it is possible to liquefy ethylene (component to be liquefied) by utilizing butane (heavy component). It is also possible to liquefy ethane by the use of isobutane, etc.

Throughout all the present description and in the claims, there will therefore be understood by:

"refrigerant", a mixture of several pure substances or main components, physically identifiable or not, circulating continuously in the incorporated cascade cycle of the open type, and the sole function of which is too produce cold;

"gas to be cooled", a gas comprising one or more pure substances or main components, of which it is desired to ensure the partial or total liquefaction, the various components to be liquefied being condensed in a fractional manner, that is to say, successively, or in a total manner, that is to say, simultaneously and together;

"light component", a pure substance or main component of the refrigerant, identical to a main component of the gas to be cooled, and especially identical to the least volatile main component of the gas to be cooled;

"heavy component", a pure substance or main component of the refrigerant, and essentially absent from the gas to be cooled, the normal boiling point of which is at least 70°C. higher than that of the least volatile main component of the gas to be cooled and therefore than that of the least volatile light component of the refrigerant;

"mixture", the mixture which is to be subjected to fractional condensation at the high pressure, and more precisely the mixture isolated before the separation of the first condensed fraction, and after the partial condensation effected by exchange of heat with an external refrigerant. This concerns the refrigerant in the pure state when the gas to be cooled is mixed with the refrigerant under the high pressure, after partial condensation, or during the fractional condensation of the said refrigerant. It is concerned with the mixture of the refrigerant and the gas to be cooled, when said gas is mixed with the refrigerant after its compression and before partial condensation, or when said gas is mixed with the refrigerant at the low pressure before compression.

By "composition by volume", there is meant a composition expressed in percentages by volume as opposed to a composition expressed in molar percentages. By "main component", there is meant a component, the percentage by volume of which (in the refrigerant, or the gas to be cooled, or the gaseous mixture) is higher than 1%; the components having a percentage by volume lower than 1% are considered as secondary components or impurities having only a negligible influence on the thermal efficiency of the method, and in consequence are not taken into account in the definition of the invention.

When it is said that a said heavy component is essentially absent from the gas to be cooled, there must be understood that said heavy component is not met in the composition by volume in main components of the gas to be cooled.

By "composition by volume in main components", there is therefore meant a composition limited to the components in which the percentage by volume is higher than 1%.

The refrigerant under low pressure becomes gradually enriched in heavy components from the cold extremity of the liquefying system up to the hot extremity at ambient temperature of said system, due to the addition of several condensed expanded fractions, while the refrigerant at the high pressure becomes gradually poorer in heavy components from the hot extremity to the cold extremity, due to the fractional condensation. Thus, the composition and the flow-rate of the refrigerant are not fixed, and furthermore, the refrigerant is only rarely identifiable as such, but may be mixed with the gas to be liquefied.

In consequence, when the refrigerant is not identifiable in the pure state, by composition, mean molecular weight, flow-rate, etc., there is understood an estimation of these values which can be effected in the two following ways:

by the addition of the gaseous or liquid or two-phase portions obtained from the mixture subjected to fractional condensation under higher pressure, expanded to at least one low pressure, and returned to a compression stage of the compressor utilized;

by the difference between the mixture subjected to fractional condensation and the sum of the ingoing fractions (including the gas to be liquefied) or the sum of the outgoing fractions (including the gas liquefied).

Thus, in the case of the accompanying drawing, the flow-rate and the composition of the refrigerant can be evaluated:

either by adding the portions expanded by the valves 15*a*, *15b* and the portion re-cycled through 18, and adding together the quantities of each component, contained by each portion;

or by subtracting the ingoing fraction 24 from the mixture coming out of 6, and subtracting the quantities of each component of the ingoing fraction from those of the mixture.

The present invention will now be described with reference to the single figure representing diagrammatically a system for the cooling of evaporations coming from a storage of liquefied natural gas, and permitting the methane (and nitrogen, if present) of the gas treated to be liquefied.

The system shown comprises a frigorific system of the open type comprising:

1. a compressor 1 of the centrifugal type, driven by means of a steam turbine 43, of which the suction 2 and the delivery 3 work respectively under a low pressure (of the order of 1.2 atmospheres absolute) and a higher pressure (of the order of 30 atmospheres absolute);
2. a condensor 5, cooled by an external circulation of a refrigerant distinct from that of the frigorific system (water, for example), the input 4 of which communicates with the delivery 3 of the compressor 1;
3. two modules of fractional condensation, arranged successively in cascade in the direction of circulation of the gaseous mixture to be condensed, the elements of the first module and of the second module being reference by numbers comprising as a respective index the letter *a* and the letter *b*. Each module comprises, in the direction of circulation of the gaseous mixture to be condensed, a separator 7, the two-phase input 8 of which communicates with a preceding condensation line (12*a* for the second separator 7*b*, outlet 6 of the condensor 5 for the first separator 7*a*); a condensation line 12 communicating at one extremity with the gaseous outlet 9 of the said separator, and at the other extremity with the two-phase input 8 of the following separator; a vaporization line 14 in heat-exchange relation with the condensation line 12; a sub-cooling passage 13 communicating at one extremity with the liquid outlet 10 of the separator 7, and at the other extremity with the upstream side of an expansion valve 15, in heat-exchange relation with the vaporization passage 14.

The condensation lines 12, the sub-cooling passages 13 and the vaporization lines 14 are arranged in the interior of the same exchanger 11. The expansion valve 15 communicates on the upstream side through the intermediary of the sub-cooling passage 13 with the liquid outlet 10 of the separator 7, and on the downstream side with the vaporization line 14 by means of a conduit 36 and a separator 41, the function of which will be explained below.

The conduits 18, 36*b*, 14*b*, 37, 16, 36*a*, 14*a*, 17, form a unitary vaporization passage communicating at one extremity with the gas outlet 20 of a final separator 19, and at the other extremity through the intermediary of a safety separator 44 with the suction 2 of the compressor 1.

4. the final separator 19, of which the two-phase inlet 22 communicates by means of an expansion valve 47 with the condensation line 12*b* of the second module of fractional condensation.
5. a supply conduit 24 for gas to be cooled, communicating at one extremity through the intermediary of the blower 23 with a storage 42 of liquefied natural gas, as at the other extremity with the circuit of the gaseous mixture treated by the compressor 1, and more precisely with the vaporization passage previously defined between the first module and the second module of fractional condensation.
6. an extraction conduit 50 for the liquefied methane, communicating at one extremity with the liquid outlet 21 of the final separator 19, and at the other extremity with the storage 42 of liquefied natural gass.
7. a storage vessel 25 associated with the first condensation module of the frigorific system, comprising at inlet 31 provided with an expansion valve 32 communicating with the liquid outlet 10*a* of the first separator 7*a*, and a gaseous outlet 27 together with a liquid outlet 26 communicating, through the intermediary respectively of the expansion valves 28 and 29, with the portion 36*a* of the vaporization passage.

The apparatus shown is further provided with a free air connection conduit 34 communicating with the gaseous outlet 20 of the final separator 19 permitting periodic blow-outs to be effected if necessary and enabling the blow-out gas to be sent towards the boilers (not shown) as fuel.

The exchangers 11*a* and 11*b* may be plate-exchangers and in this case it is appropriate to separate the refrigerant under low pressure, coming from the conduit 36, in a separator 41, and to distribute separately the gaseous and liquid phases in the vaporization passages 14 of the exchanger.

In operation, according to the invention, by means of a frigorific cycle of the open type working with a single refrigerant comprising a plurality of components, the evaporations (gas to be cooled) extracted from the storage 42 by means of the blower 23 and the conduit 24 are therefore cooled in order to liquefy the methane and possibly the nitrogen of these evaporations, and to evacuate these condensed components towards the storage 42 through the conduit 50.

The refrigerant chosen, circulating in the interior of the frigorific system previously described, comprises main components exclusively distributed between a light fraction comprising methane (the least volatile component of the light fraction) and possibly nitrogen, a heavy fraction comprising propane (the most volatile component of the heavy fraction) and butane. The result is that the mean molecular weight of the refrigerant employed is in general substantially higher than that of the evaporations treated and coming from the storage 42.

The evaporations to be cooled and condensed are brought towards the frigorific cycle, under the low pressure of this latter (about 1.5 atmospheres absolute), through the intermediary of the blower 23 (which can serve if necessary for the direct despatch of the evaporations to the boilers through the conduit 62), at an intermediate temperature comprised between the ambient temperature measured at the outlet 6 of the condenser 5 and the lower temperature delivered by the frigorific cycle, measured in the final separator 19.

The evaporations are combined in these conditions with a portion of the refrigerant at the low pressure circulating in the vaporization passage (18, 36*b*, 14*b*, 37, 16, 36*a*, 14*a*, 17) between the first exchanger 11*a* and the second exchanger 11*b*, the refrigerant then being at a temperature intermediate between the lowest temperature and the ambient temperature, previously defined, equal to or different from the intermediate temperature of introduction of the evaporations 24.

The mixture thus constituted, circulating in the conduit 16, is heated in the vaporization line 14*a* of the first exchanger 11*a*, and sent through the conduit 17 towards the suction 2 of the compressor 1. This mixture is then compressed to the high pressure of the frigorific cycle (about 30 atmospheres absolute).

The compressed mixture, subjected to a fractional condensation, identifiable between the outlet 6 of the condensor 5 and the inlet 8*a* of the separator 7*a*, comprises essentially a heavy portion comprising the heavy fraction of the refrigerant (propane and butane) together with a light portion comprising the light fraction of the refrigerant and the gas to be liquefied (methane and nitrogen, if present).

This mixture thus possesses an important discontinuity with respect to the respective volatilities of its components, since the normal boiling point of propane (the most volatile component of the heavy fraction) and the normal boiling point of methane (the lease volatile component of the light fraction) are separated by a gap of 119°C.

Since the refrigerant in gaseous form and the evaporations have been compressed together from the low pressure to the higher pressure, the mixture thus obtained is subjected to a fractional condensation at the higher pressure by means of the condensor 5 and the two modules of fractional condensation previously defined. After partial condensation of the compressed mixture in the condensor 5, in heat-exchange with a refrigerant external to the cycle (water, for example), and after the separation in the separator 7*a* of a gaseous fraction 9*a*, continuing the fractional condensation, there is obtained a first condensed fraction 10*a*.

After condensation in the line 12*a* of the gaseous fraction 9*a*, and separation in the separator 7*b* of another gaseous fraction 9*b*, there is obtained a second condensed fraction 10*b*. Each condensed fraction 10*a* or 10*b*, after sub-cooling in a passage 13, is expanded to the low pressure in a valve 15. Each expanded fraction is combined at the low pressure with the refrigerant coming from the vaporization line 14 of the previous exchanger, and vaporized with the refrigerant in a vaporization line 14 of the following exchanger, in heat-exchange with the gaseous mixture in course of fractional condensation under the higher pressure circulating in a line 12 of the said following exchanger.

The refrigerant is thus gradually heated in the lines 14 of the vaporization passage defined with respect to the frigorific system previously described, by exchange of heat with the mixture in course of condensation.

Finally, the last gaseous fraction 9*b* separated is partially condensed in the line 12*b* of the exchanger 11*b*, by exchange with the second condensed fraction 10*b* in course of vaporization in the line 14*b*, is then expanded to the low pressure in the valve 47 and finally separated in the final separator 19 into a residual gaseous portion of the refrigerant, evacuated through the outlet 20, and a liquid portion having substantially the same composition as the initial evaporations 24. This liquid portion is returned to the storage 42 after expansion in the valve 61 to a pressure in the vicinity of atmospheric pressure.

In operation, there is retained in the vessel 25, in the liquid form and at a pressure intermediate between the higher and low pressures, a reserve quantity of the heavy fraction of the refrigerant, comprising propane and butane. This reserve quantity preferably comprises, in molar percentages, between 62 and 67% of propane and between 33 and 38% of butane (not including possible impurities). This reserve can be supplied from the exterior by means of a valve 33.

This reserve quantity of refrigerant contributes to the flexibility of operation of the frigorific cycle. In fact, when the frigorific power delivered is in excess with respect to the frigorific power necessary for cooling and liquefying the evaporations, the vessel 25 is fed by extraction of a quantity of liquid from the first condensed fraction 10*a* at high pressure, by expansion in the valve 32. Conversely, when the frigorific power delivered is deficient with respect to the frigorific power necessary, there is restored, by means of the expansion valves 28 and 29, a part of the fluid retained in the storage 25 (in the liquid and gaseous form), which is combined with the first condensed fraction 10*a*, expanded to the low pressure in the valve 15*a*.

Tables 1 and 2 below indicate the characteristics of operation of a cycle such as previously described, respectively for the liquefaction of evaporations constituted essentially of methane, and for evaporations comprising approximately 80% of methane and approximately 20% of nitrogen.

The compositions, expressed in percentages by volume, the flow-rates expressed in normal cu.m. per hour (that is to say, under normal conditions of temperature and pressure), the temperatures expressed in °C. and the pressures expressed in atmospheres absolute (one atmosphere absolute = 1.013 bar), have been indicated for the fluid circulating in the different parts of the frigorific circuit, referenced numerically in the drawing accompanying the present description. In the first case, the power consumed is 5,100 kW, and in the second case 5,700 kW.

TABLE 1

| Circuit reference | Composition by volume % | | | Flow-rate in N m3/hr | Temperature °C. | Pressure in abs. atmospheres |
|---|---|---|---|---|---|---|
| | $C_1$ | $C_3$ | n-$C_4$ | | | |
| 3 | 70 | 11 | 19 | 30,110 | | 33.5 |
| 6 | | | | 30,110 | 37 | 33.0 |
| 10a | 12.4 | 19.3 | 68.3 | 3,412 | 37 | 33.0 |
| 9a | 77.4 | 9.9 | 12.7 | 26,698 | 37 | 33.0 |
| 8b | | | | 26,698 | −84 | 32.4 |
| 35a | | | | 3,412 | −84 | 32.5 |
| 10b | 67.1 | 14.4 | 18.5 | 18,334 | −84 | 32.4 |
| 9b | 99.7 | 0.2 | 0.04 | 8,364 | −84 | 32.4 |
| 40 | | | | 8,364 | −148 | 32 |

TABLE 1-continued

| Circuit reference | Composition by volume % $C_1$ | $C_3$ | n-$C_4$ | Flow-rate in N m3/hr | Temperature °C. | Pressure in abs. atmospheres |
|---|---|---|---|---|---|---|
| 35b | | | | 18,334 | −148 | |
| 36b | | | | 18,978 | −151 | 1.55 |
| 21 | 100 | 0 | 0 | 7,720 | −155 | 1.55 |
| 20 | | | | 644 | −155 | 1.55 |
| 37 | | | | 18,978 | − 94.5 | 1.45 |
| 24 | 100 | 0 | 0 | 7,720 | −137.4 | 1.5 |
| 36a | | | | 30,110 | −100 | 1.45 |
| 17 | | | | 30,110 | 27 | 1.2 |
| Evaporations mean molecular weight | | | 16.0 | Calculated by material balance-sheet on each of the constituents, carried out by comparison between 3 and 24 | | |
| Refrigerant mean molecular weight | | | 30.8 | | | |
| Refrigerant, composition by volume % | | $C_1$ | 59.7 | | | |
| | | $C_3$ | 14.8 | | | |
| | | $C_4$ | 25.5 | | | |

| Circuit reference | Composition by volume % $C_1$ | $C_3$ | n-$C_4$ | $N_2$ | Flow-rate in N m3/h | Temperature in °C. | Pressure in abs. atmospheres |
|---|---|---|---|---|---|---|---|
| 3 | 56.4 | 15.2 | 15.6 | 12.8 | 33,000 | | 33.5 |
| 6 | | | | | 33,000 | 37 | 33.0 |
| 10a | 9.8 | 27.4 | 62.0 | 0.8 | 2,733 | 37 | 33.0 |
| 9a | 60.6 | 14.1 | 11.4 | 13.9 | 30,267 | 37 | 33.0 |
| 8b | | | | | 30,267 | −98 | 32.4 |
| 35a | | | | | 2,733 | −98 | 32.5 |
| 10b | 58.8 | 20.0 | 16.3 | 4.9 | 21,157 | −98 | 32.4 |
| 9b | 65.0 | 1.1 | 0.01 | 34.9 | 9,110 | −98 | 32.4 |
| 40 | | | | | 9,110 | −160 | 32.0 |
| 35b | | | | | 21,157 | −160 | 32.0 |
| 36b | | | | | 23,107 | −165 | 1.55 |
| 21 | 80.5 | 0.15 | 0.01 | 19.4 | 7,160 | −179.6 | 1.55 |
| 20 | | | | | 1,950 | −179.6 | 1.55 |
| 37 | | | | | 23,107 | −116 | 1.45 |
| 24 | 80.6 | | | 19.4 | 7,160 | −135 | 1.5 |
| 36a | | | | | 33,000 | −118 | 1.45 |
| 17 | | | | | 33,000 | 32 | 1.2 |
| Evaporations, mean molecular weight | | | 18.3 | Calculated by material balance sheet on each of the constituents, carried out by comparison between 3 and 24. | | | |
| Refrigerant, mean molecular weight | | | 31.1 | | | | |
| Refrigerant, composition by volume % | | $C_1$ | 49.7 | | | | |
| | | $C_3$ | 19.4 | | | | |
| | | $C_4$ | 19.9 | | | | |
| | | $N_2$ | 11.0 | | | | |

The liquefying system previously described is capable of working in a completely automatic manner, according to the following principles.

Quite obviously, the operating parameters of the liquefaction cycle (pressures, temperatures, compositions) are calculated so as to cool a gas treated under nominal conditions of temperature, pressure and composition, and to obtain at least one component of the said gas in the liquid state under pre-determined final conditions. Similarly, the equipment utilized (compressor, exchangers, etc.) is defined for these same nominal conditions.

However, in exploitation, the characteristics of the gas to be cooled are capable of varying in considerable proportions; thus, in the case of a methane ship, the flow-rate and the composition of nitrogen in the evaporations may fluctuate over a considerable range. It is therefore necessary to be able to adapt the operation of the liquefying system automatically to these variations.

According to the invention, the regulation of a liquefaction installation is effected by the following method, in the case of evaporations of a liquefied natural gas, and for a pre-determined range of variations of the characteristics (for example, flow-rate and/or nitrogen content) of the gas treated. There will correspond to this range a pre-determined interval of variations of the suction pressure 2 of the compressor 1 (for example, between 1.2 atmospheres and 1.4 atmospheres absolute).

In this interval, in the first place the speed of rotation of the compressor 1 is kept constant, and secondly the ratio between the loss of pressure detected at the suction of the compressor on the conduit 17 by a depression-producing device (not shown) and on the other hand the delivery pressure is maintained constant by simultaneous action in the same direction on the valves 15*b* and 47 (excluding the valve 15*a*) working between the higher pressure and the low pressure.

Maintaining constant the speed of rotation of the compressor, and also the ratio between the loss of pressure of the depression-producing device and the delivery pressure, the volumetric flow-rate at the suction and also the compression ratio of the compressor remain constant.

This method of regulation makes it possible automatically to adapt, for a pre-determined range of operation, the parameters of the liquefaction process as a function of the characteristics of the gas to be cooled. In fact, if it is assumed, for example, that the flow-rate of the evaporations introduced through the conduit 24 increases with respect to the nominal flow-rate, the suction pressure and the delivery pressure of the compressor 1 increase correlatively in a proportional manner between each other.

The result is that the mass flow-rate treated by the compressor 1 increases in a corresponding manner, and the frigorific power delivered increases gradually so as to compensate for the excess flow-rate of the evaporations treated. Thus, by virtue of the regulation utilized, the liquefaction system evolves naturally towards a new state of equilibrium, characterized by higher working pressures, permitting the whole of the new flow-rate of gas treated to be liquefied. The same phenomena appear in the opposite sense when the flow-rate of the evaporations diminishes with respect to the nominal flow.

Similarly, when the content of nitrogen in the evaporations increases with respect to the nominal content, the pressure at the suction 2 of the compressor 1 increases correspondingly, since the final temperature reached in the separator 19 is not sufficient to evacuate the whole of the nitrogen introduced in the liquid form through the conduit 50, and in consequence, the excess nitrogen becomes re-cycled through the conduit 18 to the compressor 1.

For the same reasons as previously, the delivery pressure 3 of the compressor 1 increases in a proportional manner with that of the suction 2, and the increased higher pressure of the frigorific cycle thus obtained permits the condensation of the evaporations which have become more volatile by enrichment in nitrogen. In this case also, the liquefying device evolves naturally towards a new state of equilibrium.

If the suction pressure 2 of the compressor 1 becomes less than the minimum value (for example, 1.2 atmospheres) assigned for the pre-determined interval of variations of this pressure, the volumetric flow sucked in by the compressor is automatically reduced by any appropriate means, by reducing its speed of rotation. In particular, this makes it possible to prevent the centrifugal compressor 1 reaching its surge zone.

If this same suction pressure becomes greater than the maximum value (1.4 atmospheres, for example) assigned for this same interval, the gaseous outlet 20 of the final separator 19 is then caused to communicate automatically, for example by means of a valve 60, with the exterior of the frigorific system. This takes place especially when the content of nitrogen in the evaporations becomes too large (greater than 20 %) or when the flow-rate treated becomes largely in excess with respect to the nominal flow-rate.

However, it must be noted in this case that in view of the extraction point of the blow-out operations effected, the evacuated gas comprises very little methane (for example, of the order of 10 %) and that thus this extraction does not substantially affect the liquefaction efficiency of the frigorific cycle.

In addition, the frigorific system is regulated in the following manner. The ratio of the liquid flow-rates respectively extracted by the expansion valve 15 of the second liquefaction module (in the direction of circulation of the gaseous mixture treated), and by the expansion valve 47 arranged between the two-phase inlet 22 of the final separator 19 and the condensation passage **12*b* of the second condensation module, is held substantially constant; the expansion valve 15*a* of the first condensation module is regulated as a function of the difference in temperature detected between the hot extremity of the first condensation line 12*a* and the hot extremity of the first vaporization line 14*a***.

In addition, the stocking-up quantities of refrigerant stored in the storage vessel 25 are regulated in the following manner. The liquid expansion valve 29 associated with the liquid outlet 26 of the vessel 25 is controlled as a function of the level of the liquid existing in the separator **7*a* of the first condensation module, while the gaseous expansion valve 28 associated with the gaseous outlet 27 of the vessel 25 is controlled by the level of the liquid existing in the separator 7*b*** of the second condensation module.

Moreover, the present invention is concerned with a multicomponent refrigerant the main components of which are exclusively distributed between:

- a light fraction (i) comprising a least volatile light component,
- a heavier fraction (i.i) comprising a most volatile heavy component having a normal boiling point at least 70°C higher than the normal boiling point of said least volatile light component of (i).

Such a multicomponent refrigerant comprises in approximate percent by volume:

$45 \leq CH_4 \leq 75$ $5 \leq C_3H_8 \leq 25$ $10 \leq n\text{-}C_4H_{10} \leq 30$ While the liquefying system forming the subject of the invention is especially adapted to the re-liquefaction of the evaporations in a methane ship, it nonetheless remains true that it can be utilized for numerous other applications, in particular for the liquefaction of pure substances, as previously indicated.

What is claimed is:

1. An open-type frigorific system for liquefying at least a light fraction of a mixture of gas to be cooled and liquefied, comprising in combination:

a. a compressor the suction and the delivery lines of which are, respectively, at a low pressure and a higher pressure, b. a condenser the inlet of which communicates with the delivery line of said compressor, and the outlet of which communicates with a two-phase inlet of a first separator of a first fractional condensation module, c. said first fractional condensation module comprising in the direction of circulation of a gaseous mixture to be condensed:

said first separator, a condensation line, one end of which communicates with the gaseous outlet of said first separator, and the other end of which communicates with a two-phase inlet of a second separator, a vaporization line in heat exchange relation with at least said condensation line, said vaporization line communicating at one extremity thereof with a gaseous outlet of the vaporization line of a second fractional condensation module, and at the other extremity thereof with the suction line of said compressor, at least one expansion valve communicating on the upstream side with the liquid outlet of said first separator, and on the downstream side with said vaporization line, d. a second fractional condensation module comprising in the direction of circulation of a gaseous mixture to be condensed:

said second separator, a second condensation line, one end of which communicates with the gaseous outlet of said second separator, and the other end of which communicates with a two-phase inlet of a third separator, a second vaporization line in heat exchange relation with at least said second condensation line, said vaporization line communicating at one extremity thereof with an inlet of the vaporization line of the first fractional condensation module, at least one expansion valve communicating on the upstream side with the liquid outlet of said second separator, and on the downstream side with the inlet of said second vaporization line, e. a gas supply conduit communicating with at least one of said vaporization lines, and supplied with said light fraction of mixture of gas to be liquefied, f. a conduit for the extraction of said liquefied fraction communicating with the liquid outlet of said third separator, g. a storage vessel associated with at least one of said condensation modules, having an inlet line communicating with at least one liquid outlet of a said separator, and having at least one outlet line communicating with at least a said vaporization line, said storage vessel being at least partially filled with a liquefied gas having a normal boiling point at least 70°C. higher than that of a main constituent of said light fraction of said gas mixture to be liquefied.

2. A system of claim 1, wherein the inlet and outlet lines of said storage vessel are each provided with an expansion valve.

3. A system of claim 1, wherein said storage vessel has an inlet line, a liquid outlet line and a gas outlet line, each of said lines being equipped with an expansion valve.

4. A system of claim 3, wherein the expansion valve of said liquid outlet line is controlled as a function of the liquid level of the separator of at least one condensation module, and the expansion valve of said gas outlet line is controlled as a function of the liquid level of the separator of at least one other condensation module.

5. A system according to claim 1, comprising an expansion valve mounted at the outlet end of the condensation line of said second fractional condensation module before the two-phase inlet of said third separator.

6. A system according to claim 5, wherein said gas supply conduit communicates with the gaseous phase of a liquefied gas storage tank, and said conduit for extraction of said liquefied fraction communicates with said storage tank.

7. A system according to claim 1, wherein said storage vessel communicates with the liquid outlet of said first separator.

8. A system according to claim 1 wherein sid light fraction of gas mixture to be liquefied comprises essentially methane and said liquefied gas contained in said vessel comprises essentially propane and butane.

9. A method of liquefying at least a light fraction of a mixture of a gas by employing an open-type frigorific cycle, which comprises:

a. compressing at least said light fraction of gas from a low pressure to a higher pressure, b. storing in a storage vessel a liquefied heavier gas having a normal boiling point at least 70°C. higher than that of said light fraction of gas mixture, c. expanding in substantially gaseous form a part of said liquefied gas and mixing with said light fraction of gas mixture at said low pressure before compression thus forming a multicomponent refrigerant in gaseous form, d. subjecting said compressed multicomponent refrigerant to a fractional condensation under said higher pressure, thereby obtaining a plurality of condensed fractions, a first condensed fraction of which is obtained in heat exchange with a refrigerant external to said cycle, and the gaseous fraction separated from said first condensed fraction continues said fraction condensation, e. expanding each condensed fraction to said low pressure, f. combining, at said low pressure, at least one expanded condensed fraction with a recycled gaseous part of said refrigerant, g. vaporizing at least said expanded condensed fraction combined with at least a gaseous fraction of said refrigerant, h. heating at least said refrigerant under said low pressure in heat exchange with said light fraction of gas mixture in the course of being fractionally condensed under said higher pressure, i. separating at least a part of said light fraction to be liquefied, after its condensation in a final fractional condensation, from one gaseous recycled portion of said refrigerant, and removing said liquefied part from said frigorific cycle, and j. returing to said storage vessel at least a part of said heavier gas liquefied in said first separation in d.

10. The method of claim 9 to provide substantially complete liquefaction of the light fraction evaporating from the gas mixture, stored in said storage tank comprising:

maintaining a substantially constant volumetric gas charge flow-rate at the suction of said compressor, maintaining a substantially constant compression ratio of said compressor, and varying accordingly the pressure at the suction and delivery ends of said compressor.

11. The method of claim 10, wherein the volumetric flow-rate sucked in by said compressor is maintained as a function of the suction pressure of said compressor.

12. The method of claim 10, wherein release of a gaseous fraction from a gaseous outlet of said third separator is controlled as a function of the suction pressure of said compressor.

13. The method of claim 10, wherein the ratio of the liquid flow-rates extracted respectively through the expansion valve of said second condensation module, following the direction of circulation of the gaseous mixture being condensed, and through the expansion valve positioned between the two-phase inlet of the said third separator and the condensation line of the said second module, is maintained substantially constant; and the expansion valve of said first condensation module is regulated as a function of the difference of temperature of the hot extremity of the first condensation line and the hot extremity of the first vaporization line.

14. The method of claim 9 wherein:

said light fraction gas is introduced into said cycle at said low pressure and at a first temperature intermediate between the ambient temperature and the lowest temperature delivered by said cycle, and is so combined with said refrigerant at said low pressure and at a second intermediate temperature which is intermediate between the ambient temperature and said lowest temperature said mixture so subjected to fractional condensation comprises said refrigerant and said gas.

15. The method of claim 9, wherein:

said heavier gas stored in said storage vessel is maintained in liquid form at a pressure intermediate between said low and higher pressures and, during said cycle, said heavier gas maintained in liquid form is fed by extraction from at least one of said condensed fractions at said higher pressure when the frigorific power delivered in said cycle is in excess of the frigorific power required to cool said gas mixture, and said heavier gas maintained in liquid form is extracted by recombining a part thereof with at least one of said condensed fractions expanded at said low pressure when the frigorific power delivered in said cycle is less than the frigorific power required to cool said gas mixture.

16. The method of claim 15, wherein the heavier gas of the refrigerant is comprised essentially of propane and butane.

17. The method of claim 16, wherein the heavier gas of the refrigerant comprises from 62% to 67% of propane and from 33% to 38% of butane, in molar percentages.

18. The method of claim 9 wherein said light fraction of gas comprises essentially methane, and the most volatile component of said heavier gas is propane.

* * * * *